US009385492B2

(12) United States Patent
Chen

(10) Patent No.: US 9,385,492 B2
(45) Date of Patent: Jul. 5, 2016

(54) SWITCH CONNECTOR COMPRISING AN INSULATIVE BOVY OVER AN INULATIVE BASE THAT COMPRISES TWO INSULATORS

(71) Applicant: HON HAI PRECISION INDUSTRY CO., LTD., New Taipei (TW)

(72) Inventor: Ming-Ching Chen, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 1 day.

(21) Appl. No.: 14/485,974

(22) Filed: Sep. 15, 2014

(65) Prior Publication Data

US 2015/0075953 A1 Mar. 19, 2015

(30) Foreign Application Priority Data

Sep. 13, 2013 (TW) ..... 102133100 U

(51) Int. Cl.

| | |
|---|---|
| ***H01R 33/96*** | (2006.01) |
| ***H01R 24/46*** | (2011.01) |
| ***H01R 24/50*** | (2011.01) |
| ***H01R 43/24*** | (2006.01) |
| *H01R 103/00* | (2006.01) |

(52) U.S. Cl.

CPC ..... *H01R 24/46* (2013.01); *H01R 24/50* (2013.01); *H01R 43/24* (2013.01); *H01R 2103/00* (2013.01); *Y10T 29/49105* (2015.01)

(58) Field of Classification Search

CPC ..... H01R 13/7032; H01R 13/7036; H01R 2103/00

USPC ..... 200/51.09, 51.1

See application file for complete search history.

(56) References Cited

U.S. PATENT DOCUMENTS

| | | | | |
|---|---|---|---|---|
| 6,068,492 | A | 5/2000 | Uratani et al. | |
| 6,783,374 | B2 * | 8/2004 | Uratani | H01R 9/0515 439/188 |
| 8,038,450 | B2 | 10/2011 | Nakagawa | |
| 8,066,516 | B2 | 11/2011 | Hoshiba et al. | |
| 8,113,857 | B1 | 2/2012 | Huang | |

FOREIGN PATENT DOCUMENTS

| | | |
|---|---|---|
| TW | M431419 | 6/2012 |

* cited by examiner

*Primary Examiner* — Vanessa Girardi

(74) *Attorney, Agent, or Firm* — Ming Chieh Chang; Wei Te Chung

(57) ABSTRACT

A switch connector includes an insulative base, a fixed terminal, a movable terminal inserted molded with the insulative base, an insulative body assembled with the insulative base, and a shielding shell enclosing the insulative body. The fixed terminal has a block portion and the movable terminal has an elastic arm, the block portion elastically contacts the elastic arm. The insulative base includes a first insulator having a terminal receiving passageway and a second insulator. The fixed terminal is inserted molded in the first insulator, the movable terminal is received in the terminal receiving passageway, and the second insulator over-molds the movable terminal and the first insulator. A method of making a switch connector includes: insert molding a fixed terminal with a first insulator; disposing a movable terminal in the first insulator; over-molding a second insulator on the moveable terminal and the first insulator.

19 Claims, 6 Drawing Sheets

SWITCH CONNECTOR COMPRISING AN INSULATIVE BOVY OVER AN INULATIVE BASE THAT COMPRISES TWO INSULATORS

BACKGROUND OF THE INVENTION

1. Field of the Invention

The present invention relates to a small switch connector and a method of making the switch connector and especially relates to integrating a fixed terminal and a movable terminal to an insulative base of the switch connector.

2. Description of Related Art

U.S. Pat. No. 8,113,857 discloses a switch connector including, among others, an insulative base, a movable terminal and a fixed terminal insert molded in the insulative body, and a plate mounted at a bottom of the insulative base. Since the movable and fixed terminals are directly insert molded in the insulative base after forming the movable and fixed terminals, positional relationship between the fixed terminal and the movable terminal is hard to control.

U.S. Pat. No. 6,068,492 discloses a switch connector including, among others, an insulative case, a movable terminal, and a fixed terminal. The insulative case includes a first part insert-molded with the fixed terminal and a second part insert-molded with the movable terminal. The first part and the second apart then are fitted to each other. Since the insulative case is consisted of two fitted parts, the structure may not be sufficiently strong.

An improved switch connector and a method of making the switch connector are desired.

SUMMARY OF THE INVENTION

Accordingly, an object of the present invention is to provide a switch connector including a movable terminal and a fixed terminal stably retained in an insulative base.

In order to achieve the object set forth, the present invention provides a switch connector comprising: an insulative base; a fixed terminal and a movable terminal inserted molded with the insulative base, the fixed terminal having a block portion, the movable terminal having an elastic arm, the block portion elastically contacting the elastic arm; an insulative body assembled with the insulative base; and a shielding shell enclosing the insulative body; wherein the insulative base comprises a first insulator having a terminal receiving passageway and a second insulator, the fixed terminal inserted molded in the first insulator, the movable terminal received in the terminal receiving passageway, the second insulator overmolding the movable terminal and the first insulator.

In order to achieve the object set forth, the present invention also provides a method of making a switch connector, including the steps of:

(1) forming a first framework by insert molding a fixed terminal with a first insulator, the first framework having a terminal receiving passageway;
(2) disposing a movable terminal in the receiving passageway;
(3) over-molding a second insulator on the moveable terminal and the first insulator to form a second framework, the first insulator and the second insulator constituting an insulative base positioning the fixed terminal and the movable terminal; and
(4) bending the fixed terminal while pressing the movable terminal to establish an elastic contact between the fixed terminal and the movable terminal.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
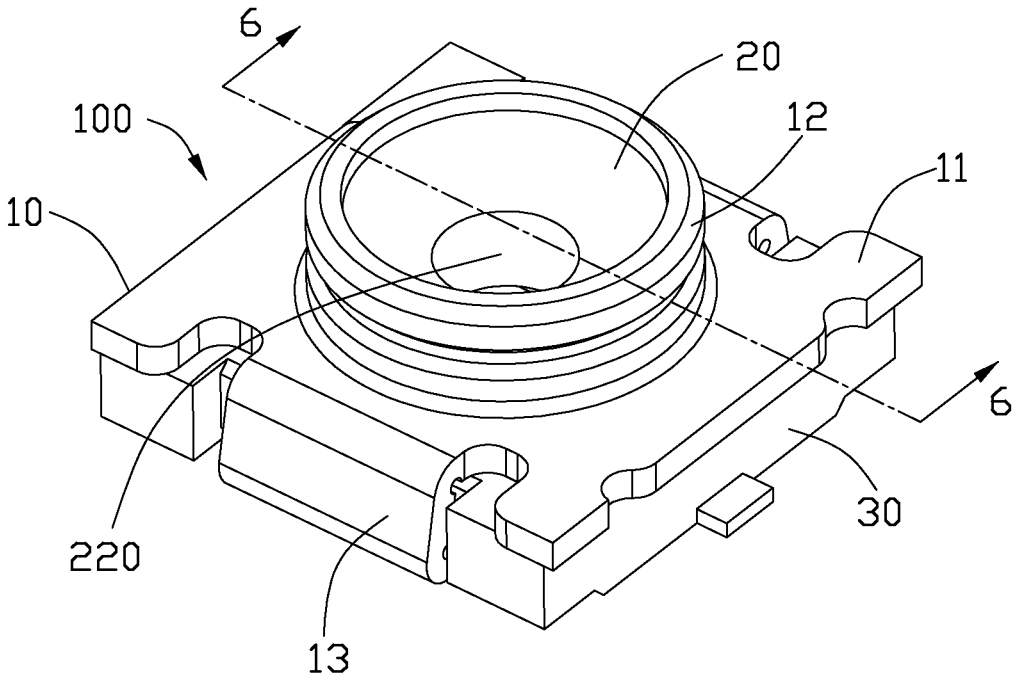
FIG. 1 is a perspective view of a switch connector according to the present invention.
Figure 2:
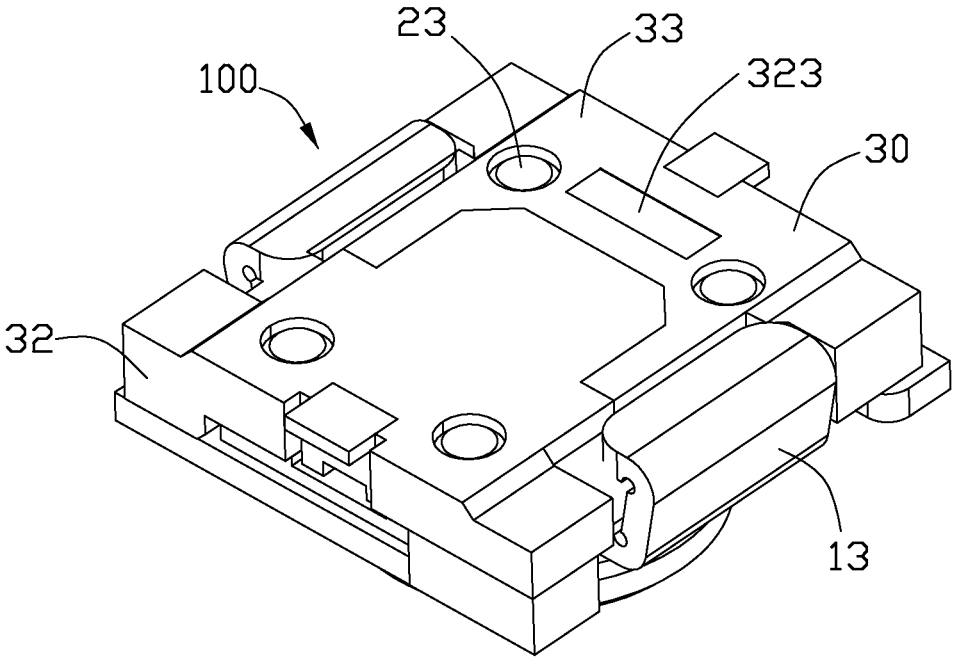
FIG. 2 is another perspective view of the switch connector in FIG. 1.

Referring to FIG. 1 and FIG. 2, a switch connector 100 according to the present invention includes a shield shell 10, an insulative body 20 received in the shield shell 10, an insulative base 30 assembled with the insulative body 20, a fixed terminal or stationary contact 40, and a movable terminal or deflectable contact 50. Both of the fixed terminal 40 and the movable terminal 50 are inserted in the insulative body 20. The shield shell 10 includes a reference surface 11, a cylindrical shell 12 upward extending from the reference surface 11, and two retention arms 13. Each of retention arms 13 downward extends from one side of the reference surface 11. The retention arm 13 downward extends through a side wall of the insulative base 30 to a bottom of the insulative base 30. The retention arm 13 is then bent to stably retain the shield shell 10 to the insulative base 30.

Figure 4:
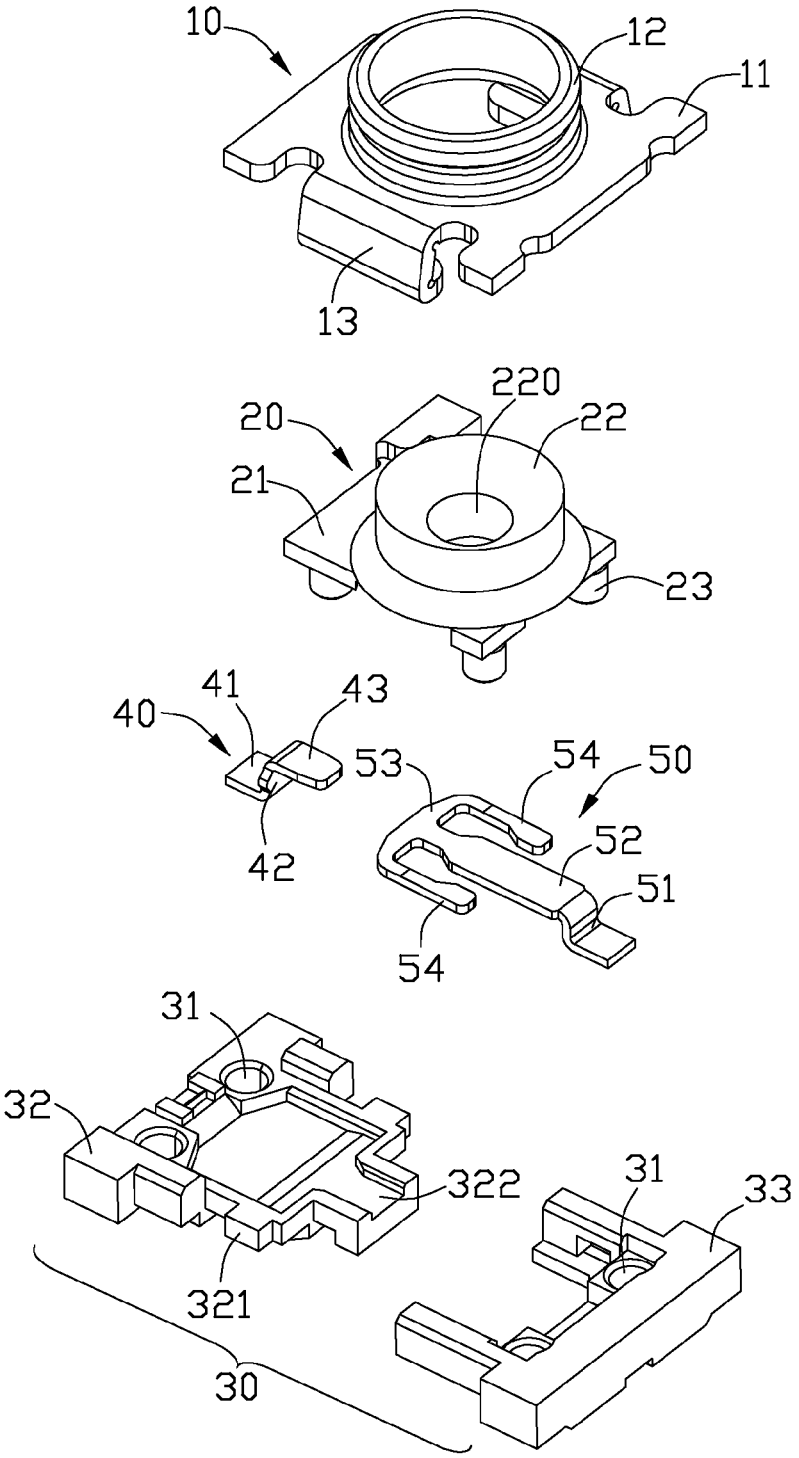
FIG. 4 is an exploded view of the switch connector.
Figure 5:
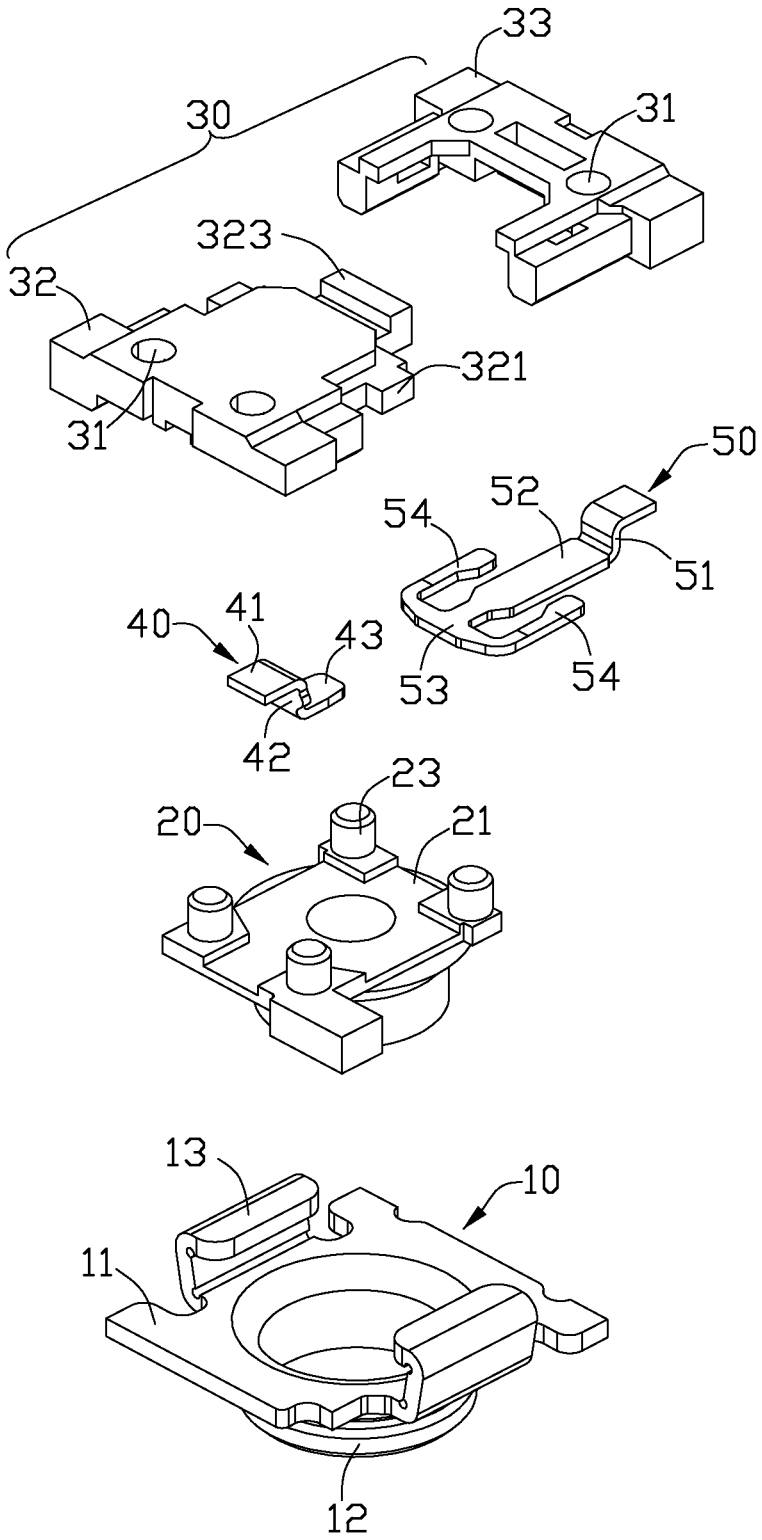
FIG. 5 is another exploded view of the switch connector in FIG. 4.

Referring to FIG. 4 to FIG. 5, the insulative body 20 includes a mounting face 21, an insulative post 22 extending upward from the mounting face 21 and four mounting post 23. The reference surface 11 of the shield shell 10 attaches to upper the mounting face 21. The insulative post 22 has a receiving space 220 for receiving a mating connector. The insulative post 22 is received in the cylindrical shell 12 of the shield shell 10. The insulative base 30 having a mounting hole 31, the mounting post 23 is retained in the mounting hole 31 to put the insulative body 20 and the insulative base 30 together.

The insulative base 30 includes a first insulator 32 and a second insulator 33 integrated with the first insulator 32. The first insulator 32 includes two side walls 320 and a first tab 321 bulging from the side wall 320. The first tab 321 is insert molded in the second insulator 33 via a second forming.

Figure 3:
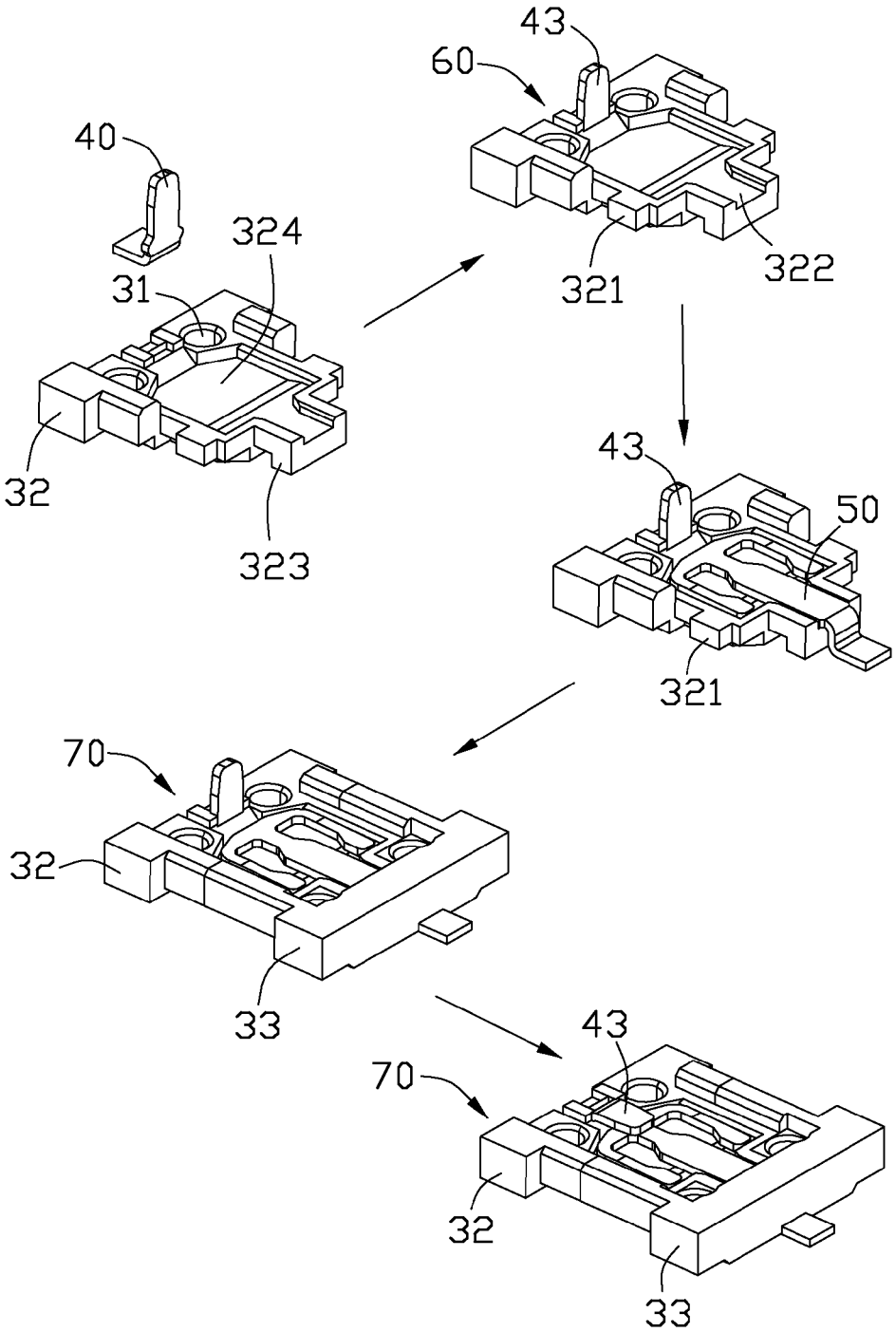
FIG. 3 is a flow diagram of two forming processes of an insulative base of the switch connector.

Referring to FIG. 3, the fixed terminal 40 includes a connecting portion 42 insert molded in the insulative base 30, a soldering tail 41 horizontally extending beyond the insulative base 30 from a lower end of the connection portion 42, and a block portion 43 extending beyond the insulative base 30 from the connecting portion 42. The movable terminal 50 includes a retention portion 51 insert molded in the insulative base 30, a soldering tail 41 horizontally extending beyond the insulative base 30 from a lower end of the retention portion 51, an elastic arm 52 horizontally extending to the fixed terminal 40, a contact portion 53 at one end of the elastic arm 52, and two elastic claws 54. Each of the elastic claws 54 is at one side of the contact portion 53 and extends to the retention portion 51. The contact portion 53 is under the block portion 43 of the fixed terminal 40. The elastic claws 54 enhance elastic dynamics of the movable terminal 50.

The first insulator 32 defines a terminal receiving passageway 322. The retention portion 51 of the movable terminal 50 is received in the terminal receiving passageway 322. In the second time forming process, the second insulator 33 is embedded into the terminal receiving passageway 322 to stably retain the movable terminal 50. The insulative base 30 defines a receiving cavity 324 and a second tab 323 bulging from below of the terminal receiving passageway 322. The second tab 323 is over-molded with the second insulator 33. This over molding strengthens structure of the insulative base 30. The movable terminal 50 is received in the receiving cavity 324. The contact portion 53 of the elastic arm 52 is spaced apart from the insulative base 30 to provide a space for downward movement of the movable terminal 50 upon pressing.

A method of making the switch connector 100 includes the following steps:

(1) forming the first framework 60 by insert molding the fixed terminal 40 with the first insulator 32, the first framework 60 having a terminal receiving passageway 322;

(2) disposing a movable terminal 50 in the terminal receiving passageway 322;

(3) overmolding a second insulator 33 on the moveable terminal 50 and the first insulator 32 to form a second framework 70, the first insulator 32 and the second insulator 33 constituting an insulative base 30 positioning the fixed terminal 40 and the movable terminal 50; and (4) bending the fixed terminal 40 while pressing the movable terminal 50 to establish an elastic contact between the fixed terminal 40 and the movable terminal 50.

The fourth step of the method controls a bending range in order to make the elastic arm 52 stably connect with the block portion 43.

Figure 6:
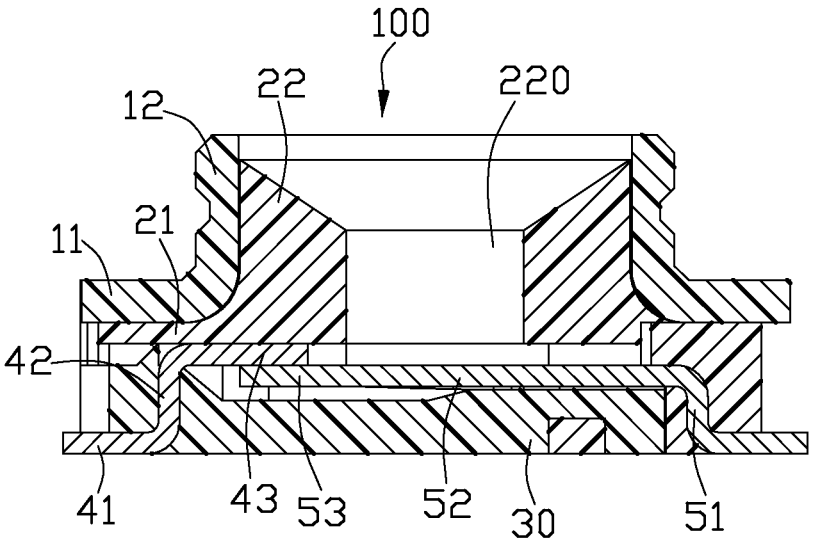
FIG. 6 is a cross-sectional view of the electrical connector taken along line 6-6 of FIG. 1.

Referring to FIG. 6, the fixed terminal 40 contacts with the movable terminal 50 before the switch connector 100 is mated with a mating connector. At this position, the contact portion 53 of the movable terminal 50 upwardly elastically abuts the block portion 43 of the fixed terminal 40. When the switch connector 100 mates with the mating connector, a center conductor of the mating connector will push the elastic arm 52 of the movable terminal 50 down to disconnect the contact portion 53 of the movable terminal 50 from the block portion 43 of the fixed terminal 40, thereby realizing a switching function.

Different from prior art, the movable terminal 50 and the fixed terminal 40 of the switch connector 100 of the present invention are integrated with the insulative base 30 via two-shots forming process of the insulative base 30. The movable terminal 50 and the fixed terminal 40 thus are stably retained in the insulative base of a stronger structure.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. A switch connector comprising:

a first insulator;

a stationary contact joined within the first insulator and defining a stationary contacting section and a tail section;

a deflectable contact assembled upon the first insulator and defining tail portion and a moveable contacting section which is overlapped with the stationary contacting section in a vertical direction and is deflectable in said vertical direction to determine an on-off status therebetween;

a second insulator over-molded upon both the deflectable contact and the first insulator so as to have the first insulator, the second insulator joined together as an insulative base with therein said deflectable contact in an embedded manner;

an insulative body assembled upon said insulative base, wherein said insulative body defines a passage for receiving a plug therein to switch said on-off status; wherein said deflectable contact is spaced from the insulative body in a vertical direction.

2. The switch connector as claimed in claim 1, wherein the stationary contact is insert-molded within the first insulator.

3. The switch connector as claimed in claim 1, further including a metallic shell to cover said insulative body and fasten the insulative body and the insulative base together.

4. The switch connector as claimed in claim 1, wherein the stationary contact further includes a connecting portion between the stationary contacting section and the tail section, and said connecting portion is fully embedded within the first insulator without transverse exposure to an exterior.

5. The switch connector as claimed in claim 1, wherein said first insulator defines an recess in a top face to comply with a contour of the stationary contact so as to horizontally restrain said stationary contact before said second insulator is overmolded upon the first insulator.

6. The switch connector as claimed in claim 1, wherein said insulative body downwardly abuts against the stationary contacting section to assure said contacting section is located at a horizontal position to confront said deflectable contacting section.

7. The switch connector as claimed in claim 1, wherein said first insulator defines an upward oblique surface around a center region thereof to upwardly confront the deflectable contacting section.

8. The switch connector as claimed in claim 1, wherein the deflectable contact further includes a tail section exposed upon an undersurface of the first insulator, and a retention portion linked between the moveable contacting section and the tail section, and said retention portion is fully embedded within the second insulator without transverse exposure to an exterior.

9. The switch connector as claimed in claim 1, wherein said stationary contacting section originally does not extend horizontally to allow the deflectable contact to be downwardly assembled upon the first insulator, while is successively bent to a horizontal position to be overlapped with the deflectable contacting section in said vertical direction.

10. The switch connector as claimed in claim 9, wherein said contacting section is bent to the horizontal position after the second insulator is overmolded upon the first insulator.

11. The switch connector as claimed in claim 1, wherein the insulative body includes means to be secured to both said first insulator and said second insulator, respectively.

12. The switch connector as claimed in claim 11, wherein said means includes a plurality of downwardly extending posts to be received within corresponding holes in said first insulator and said second insulator, respectively.

13. A switch connector comprising:

an insulative base;

a fixed terminal and a movable terminal inserted molded with the insulative base, the fixed terminal having a block portion, the movable terminal having an elastic arm, the block portion elastically contacting the elastic arm;

an insulative body assembled with the insulative base; and a shielding shell enclosing the insulative body;

wherein the insulative base comprises a first insulator having a terminal receiving passageway and a second insulator, the fixed terminal inserted molded in the first insulator, the movable terminal received in the terminal receiving passageway, the second insulator over-molding the movable terminal and the first insulator; wherein the fixed terminal includes a soldering tail exposed on an undersurface of the insulative base, and a connecting portion linked between the block portion and the soldering tail, wherein the connecting portion is fully embedded within the insulative base without transverse exposure to an exterior.

14. The switch connector as claimed in claim 13, wherein the first insulator comprising two side walls and a first tab bulging from the side wall, the first tab is insert-molded in the second insulator via a second forming.

15. The switch connector as claimed in claim 13, wherein the insulative base further comprising a receiving cavity, the elastic arm of the movable terminal received in the receiving cavity, the elastic arm comprising a contact portion, the contact portion is spaced apart from the first insulator to provide a space for the movable terminal downward pressing.

16. The switch connector as claimed in claim 13, wherein the moveable terminal includes a soldering portion exposed upon the undersurface of the insulative base, and a retention portion linked between the elastic arm and the soldering portion, wherein said retention portion is embedded within the insulative base without transverse exposure to the exterior.

17. The switch connector as claimed in claim 13, wherein the shield shell of the switch connector comprising a retention arm downward extending from a side, the retention arm extends through the side wall of the insulative base to a bottom of the insulative base.

18. The switch connector as claimed in claim 13, wherein the movable terminal comprising a retention portion insert-molded in the second insulator, the retention portion of the movable terminal received in said terminal receiving passageway, the second insulator inserts into the terminal receiving passageway.

19. The switch connector as claimed in claim 18, wherein the first insulator having a second tab bulging from below of the terminal receiving passageway, the second insulator encloses the second tab.

* * * * *